US007879153B1

(12) United States Patent
Seo et al.

(10) Patent No.: US 7,879,153 B1
(45) Date of Patent: Feb. 1, 2011

(54) METHOD FOR CLEANING METAL NANOPARTICLES

(75) Inventors: Jung-Wook Seo, Hwasung-si (KR); Hyo-Seung Nam, Hwasung-si (KR); Young-Ku Lyu, Seoul (KR); Kyung-Mi Kim, Suwon-si (KR); Jong-Sik Kim, Seoul (KR); Tae-Ho Kim, Suwon-si (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 0 days.

(21) Appl. No.: 12/835,432

(22) Filed: Jul. 13, 2010

(30) Foreign Application Priority Data

Feb. 26, 2010 (KR) ..... 10-2010-0018163

(51) Int. Cl.
*B08B 3/04* (2006.01)

(52) U.S. Cl. ..... 134/19; 134/1; 134/2; 134/3; 134/26; 134/27; 134/28; 134/30; 134/34; 134/35; 134/36; 134/41; 134/42

(58) Field of Classification Search ..... 134/1, 134/2, 3, 19, 26, 27, 28, 30, 34, 35, 36, 41, 134/42; 510/488, 505, 509
See application file for complete search history.

(56) References Cited

U.S. PATENT DOCUMENTS 7,081,234 B1 * 7/2006 Qi et al. ..... 423/592.1

* cited by examiner

*Primary Examiner*—Sharidan Carrillo
(74) *Attorney, Agent, or Firm*—McDermott Will & Emery LLP

(57) ABSTRACT

It relates to a method for removing a surfactant, organic materials and chlorine ions remained on the surface of metal nanoparticles, prepared on an organic solvent phase including a surfactant. The method for cleaning metal nanoparticles herein is efficient to remove organic materials or chlorine ions remained on the surface of the nanoparticles. Not less than 90% of impurities may be removed by this method. As a result, the thickness of a multi layer ceramic capacitor (MLCC) can be reduced and a packing factor can be improved so that it allows thinner multi layer ceramic capacitors and improved utilities of metal nanoparticles as fuel cell catalysts, hydrogenation reaction catalysts, alternative catalysts of platinum (Pt) in chemical reactions and the like.

13 Claims, 2 Drawing Sheets

METHOD FOR CLEANING METAL NANOPARTICLES

CROSS-REFERENCE TO RELATED APPLICATIONS

This application claims the benefit of Korean Patent Application No. 10-2010-0018163 filed on Feb. 26, 2010, with the Korea Intellectual Property Office, the contents of which are incorporated here by reference in their entirety.

BACKGROUND

1. Technical Field

The present invention relates to a method for removing surfactants, organic materials and chlorine ions existing on the surface of metal nanoparticles which are prepared by using an organic solvent including a surfactant.

2. Description of the Related Art

Korean Patent No. 10-0845688 discloses a method for removing $Ni(OH)_2$ and impurities existing on the surface of nickel particles by using a reductive organic solvent to increase the purity of the metal by removing nickel hydroxides and metal oxides. JP H4-235201 A discloses a method for increasing a tap density of metal powder by adding the metal powder into an organic solvent including a stearic acid and evaporating out the organic solvent from the mixture. Such a conventional method may cause coagulation between particles during the evaporating process of the solvent when the solvent is evaporated by heating. This method is usually effective when nickel hydroxides or nickel oxides are presented on the surface of metal nanoparticles.

The metal nanoparticles, which are prepared on an organic solvent phase including a surfactant, are well dispersed in a non-polar solvent such as toluene and hexane. A polar solvent such as alcohol and acetone is then added into the mixture solution including such well-dispersed nanoparticles, and the nanoparticles are precipitated out as powder by employing a centrifugal separator. However, when this method is used, even though the organic solvent and the surfactant remaining on the surface of the nanoparticles are removed by using alcohol and toluene, organic materials, particularly chlorine ions used as a reactant, can be still remained after such washings. When the organic materials and the chlorine ions are remained on the surface of the nanoparticles, it deteriorates electrode characteristics of a multi layer ceramic capacitor (MLCC) or it may be toxic when they are used for human being products.

Therefore, it is highly demanded to develop a more effective method to remove such chlorine ions in the process of manufacturing metal nanoparticles.

SUMMARY

In order to resolve the problems described above, it is completed by providing a more efficient cleaning method in the process of manufacturing metal nanoparticles.

Thus, an aspect of the invention is to improve the purity of metal nanoparticles by effectively removing organic materials and chlorine ions used during the manufacturing process of metal nanoparticles.

According to an aspect of the invention, there is provided a method for cleaning metal nanoparticles including: removing a surfactant existing on the surface of the metal nanoparticles, prepared on an organic solvent phase including a surfactant, by treating with ethanol and toluene; removing organic materials existing on the surface of the surfactant-removed metal nanoparticles by treating with an alcohol solution or an organic acid solution; and removing chlorine ions from the organic materials-removed metal nanoparticles by treating with a carbonic acid functional group-containing solution, acidic solution, ethylene glycol or pure water.

According to an embodiment, the alcohol solution may include C1-C10 alcohols.

According to an embodiment, the alcohol solution may include 5-100 vol % alcohols.

According to an embodiment, the organic acid solution may include $C_nH_{2n+2}COOH$ or $C_nH_{2n}COOH$ ($0 \leqq n \leqq 12$, n=a natural number).

According to an embodiment, the carbonic acid functional group-containing compound may be ammonium bicarbonate ($NH_4HCO_3$) or metal bicarbonate ($MHCO_3$, M is a metal).

According to an embodiment, the metal bicarbonate ($MHCO_3$, M is a metal) may be at least one chosen from sodium bicarbonate ($NaHCO_3$), potassium bicarbonate ($KHCO_3$), lithium bicarbonate ($LiHCO_3$), rubidium bicarbonate ($RbHCO_3$), magnesium bicarbonate ($MgHCO_3$) and calcium bicarbonate ($CaHCO_3$).

According to an embodiment, the carbonic acid functional group-containing solution may include 0.1-100 wt % of a carbonic acid functional group-containing compound.

According to an embodiment, the carbonic acid functional group-containing solution may include 10-30 wt % of a carbonic acid functional group-containing compound.

According to an embodiment, the acidic solution may include at least one acid chosen from acetic acid, hydrochloric acid, nitric acid and sulfuric acid.

According to an embodiment, the ethylene glycol may be used by 1-100 times in volume of the metal nanoparticles.

According to an embodiment, a heating or ultrasonic treatment may be performed together in each step.

According to an embodiment, the metal nanoparticles may be heated at 30-300 ∟.

According to an embodiment, the metal nanoparticles may be treated with 1-10 MW of ultrasonic wave for 10 seconds to 24 hours.

The method for cleaning metal nanoparticles herein is efficient to remove organic materials or chlorine ions existing on the surface of the nanoparticles. Not less than 90% of impurities may be removed by this method. As a result, the thickness of a multi layer ceramic capacitor (MLCC) can be reduced and a packing factor can be improved so that it allows thinner multi layer ceramic capacitors and improved utilities of metal nanoparticles as fuel cell catalysts, hydrogenation reaction catalysts, alternative catalysts of platinum (Pt) in chemical reactions and the like.

DETAILED DESCRIPTION

It will be described in more detail hereinafter.

The present invention provides a method for cleaning metal nanoparticles including: removing a surfactant existing on the surface of the metal nanoparticles, prepared on an organic solvent phase including a surfactant, by treating with ethanol and toluene; removing organic materials existing on the surface of the surfactant-removed metal nanoparticles by treating with an alcohol solution or an organic acid solution;

and removing chlorine ions from the organic materials-removed metal nanoparticles by treating with a carbonic acid functional group-containing compound solution, acidic solution, ethylene glycol or pure water.

When metal nanoparticles are prepared through a conventional manufacturing method using organic solvents, several kinds of impurities may be remained on the surface of the metal nanoparticles. A surfactant can be removed by washing with ethanol and toluene, regardless of polar or non-polar. However, organic materials and chlorine ions used as a reactant may be remained on the surface of the particles even with such washings so that it reduces the purity of the metal nanoparticles.

Thus, it requires a treatment of an organic acid or alcohol solution in order to remove such organic materials after the treatment of ethanol and toluene. The alcohol may be C1-C16 alcohols, particularly C1-C10 alcohols. when an alcohol having more than 16 carbon atoms is used, it may be solid in an oil phase and have a low solubility in water.

Figure 2:
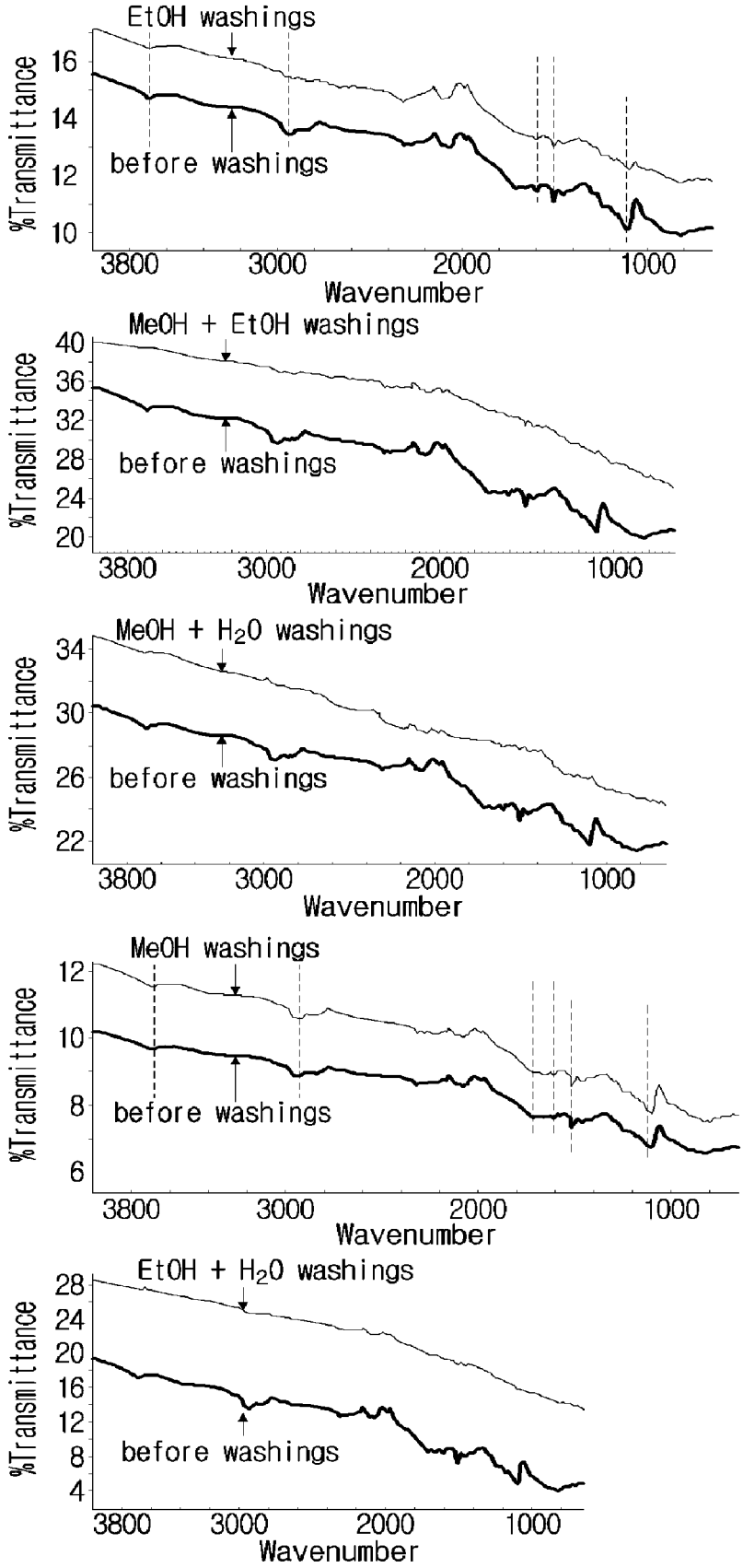
FIG. 2 illustrates washing efficiencies of solvents of alcohol and a mixture of alcohol and water.

FIG. 2 illustrates washing efficiencies of organic materials when they are washed with ethanol or methanol or its aqueous solution. When they are washed with an aqueous alcohol solution, it shows better washing efficiency than when they are washed with ethanol or methanol itself since amount of the organic materials after washing is significantly different, compared to before washing.

Here, a volume ratio of alcohol in the alcohol solution may be 5-100 vol %. When it is less than 5 vol %, organic materials may be still remained. An organic acid solution may be also used to remove remained organic materials, instead of the alcohol solution. The organic acid may be $C_nH_{2n+2}COOH$ or $C_nH_{2n}COOH$ ($0 \leqq n \leqq 12$, n=natural number). Such organic acids may remove efficiently the organic materials without causing rapid oxidation of a metal.

The organic materials-removed metal nanoparticles may be further treated with a carbonic acid functional group-containing compound solution such as a solution of ammonium bicarbonate ($NH_4HCO_3$) or metal bicarbonate ($MHCO_3$, M is a metal).

Here, the metal bicarbonate ($MHCO_3$, M is metal) may be at least one chosen from sodium bicarbonate ($NaHCO_3$), potassium bicarbonate ($KHCO_3$), lithium bicarbonate ($LiHCO_3$), rubidium bicarbonate ($RbHCO_3$), magnesium bicarbonate ($MgHCO_3$) and calcium bicarbonate ($CaHCO_3$).

Table 1 shows concentration of chlorine ions remaining on the surface of metal nanoparticles after washing with a carbonic acid functional group-containing compound. It is noted that the concentration of chlorine ions is reduced much more by washing with a solution of ammonium bicarbonate having a carbonic acid functional group than by washing with acetic acid or methanol solution as shown in Table 1. The carbonic acid functional group-containing compound in the carbonic acid functional group-containing compound solution may be 1-50 wt %, preferably 10-30 wt %. When it is less than 10 wt %, it may not remove chlorine ions enough. When it is less than 1 wt %, its washing efficiency may be very poor or a long treatment time may be required since the reaction possibility between the carbonic acid functional groups and the chlorine ions is much lowered. On the other hand, when it is more than 50 wt %, it may not be economical since the washing efficiency against chlorine ions is not increasing any further.

Further, acetic acid, hydrochloric acid, nitric acid or sulfuric acid may be used instead of the carbonic acid functional group-containing compound. When pure water is used to remove chlorine ions, the higher temperature of a washing solution is and the more number of washings are performed, the less concentration of the chlorine ions is remained of which result is shown in Table 2. Another material which shows high washing efficiency against chlorine ions is ethylene glycol. When nickel nanoparticles are washed with ethylene glycol to remove chlorine ions remaining on the surface thereof, its washing efficiency is very high (see Table 3). The amount of ethylene glycol to remove chlorine ions may be 1 to 100 times, preferably 5 to 100 times, more preferably 10 to 100 times in volume with respect to the amount of metal nanoparticles.

When the amount of ethylene glycol is less than 1 time in volume to that of metal nanoparticles, it may show little washing efficiency against chlorine ions and when it is used more than 100 times in volume, it may increase viscosity too much.

The metal nanoparticles may be nickel nanoparticles.

In each washing step, heating or ultrasonic treatment of the metal nanoparticles may be performed together. When heating is performed, its temperature may be 30-300° C. When it is lower than 30° C., heating effect may not enough to remove chlorine ions and when it is higher than 300° C., it may cause boiling of solution or forming bubbles so that metal nanoparticles may stick to the wall of a reactor and be lost.

Heating treatment and ultrasonic treatment may be performed together at a power level of 1 W-10 MW for 10 seconds to 24 hours. When the power level is less than 1 W, chlorine ions may hardly react, so that the washing efficiency becomes very poor and when it is more than 10 MW, it may give over-impact to metal nanoparticles, so that it may deteriorate surface roughness and physical properties of metal nanoparticles. When treatment time is less than 10 seconds, it is too short to remove chlorine ions efficiently and when it is longer than 24 hours, the process may be too much delayed.

Figure 1:
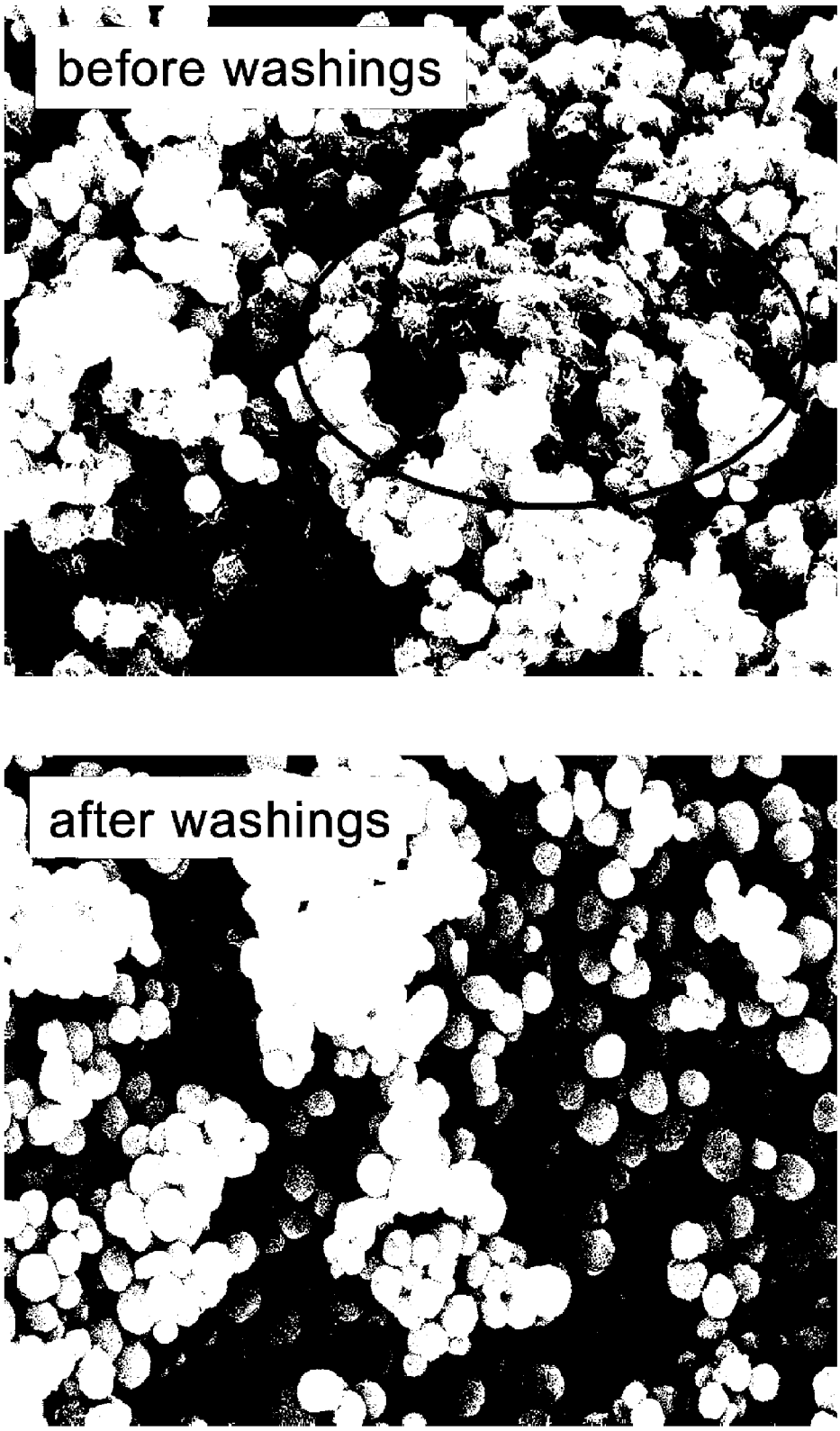
FIG. 1 illustrates the surface of rough metal nanoparticles cleaned according to the present invention.

FIG. 1 is a picture illustrating the surface of the metal nanoparticles after washing process. It is noted that agglomerated impurities are reduced after washing (right), compared to before washing (left).

While the present invention has been described with reference to particular embodiments, it is to be appreciated that various changes and modifications may be made by those skilled in the art without departing from the spirit and scope of the present invention, as defined by the appended claims and their equivalents. Throughout the description of the present invention, when describing a certain technology is determined to evade the point of the present invention, the pertinent detailed description will be omitted The terms used in the description are intended to describe certain embodiments only, and shall by no means restrict the present invention. Unless clearly used otherwise, expressions in the singular number include a plural meaning. In the present description, an expression such as "comprising" or "consisting of" is intended to designate a characteristic, a number, a step, an operation, an element, a part or combinations thereof, and shall not be construed to preclude any presence or possibility of one or more other characteristics, numbers, steps, operations, elements, parts or combinations thereof.

EXAMPLE 1

Removal of Organic Materials from Metal Nanoparticles

Metal nanoparticles, which were prepared on an organic solvent phase including an amine and a surfactant, were recovered by employing a centrifugal separator. The recovered metal nanoparticles were washed with methanol (MeOH) while performing ultrasonic treatment for 10 minutes. The same washing process was performed with ethanol (EtOH), methanol+ethanol (MeOH+EtOH), methanol+pure water (MeOH+$H_2O$ (v/v 9:1)), and ethanol+pure water (EtOH+$H_2O$ (v/v 9:1)). FIG. 2 illustrates the surface of nanoparticles after each washing process taken by FT-IR (Fourier Transform Infrared Spectroscopy, Perkin-Elmer). It is noted that when water is not used, there are peaks showing present of organic materials remaining on the surface of the nanoparticles, while there was no peak for organic materials and the graph was smooth when a water-containing washing solution is used.

EXAMPLE 2

Removal of Chlorine Ions from the Surface of Nanoparticles

After washing nanoparticles with ethanol twice and toluene twice, the nanoparticles were washed with acetic acid while performing ultrasonic treatment for 10 minutes. The same washing process was performed with methanol+pure water (MeOH+$H_2O$ (9:1, v/v)) and ammonium bicarbonate solution (10 w.t %). Each nanoparticles was then dried and analyzed for the presence of chlorine ions remaining on the surface of the nanoparticles by using ion chromatography (IC) as shown in Table 1. It is noted that when the nanoparticles were washed with ammonium bicarbonate, chlorine ions were removed the most.

TABLE 1

| | Concentration of remaining chlorine ions (g/L) |
|---|---|
| Bare (no treatment) | 5.6 |
| Acetic acid | 1.4 |
| methanol + pure water (MeOH + $H_2O$) | 3.1 |
| ammonium bicarbonate | 0.1 |

EXAMPLE 3

Removal of Chlorine Ions from the Surface of Nanoparticles

After washing nanoparticles with ethanol twice and toluene twice, the nanoparticles were washed with pure water. The nanoparticles was analyzed for the presence of chlorine ions remaining on the surface of the nanoparticles, depending on temperature of pure water and the number of washings by using ion chromatography (IC) as shown in Table 2. It is noted that when the temperature was 80° C., the more number of washings were performed the better washing efficiency against chlorine ions were.

TABLE 2

| Concentration of remaining chlorine ions (g/L) | | | |
|---|---|---|---|
| | Washing temperature | | |
| Number of washings | 70 L | 75 L | 80 L |
| 0 | 5.1 | 5.1 | 5.1 |
| 5 | 2.5 | 1.4 | 0.71 |
| 10 | 2.1 | 1.1 | 0.41 |
| 15 | 1.7 | 0.65 | 0.24 |

EXAMPLE 4

Removal of Chlorine Ions from the Surface of Nanoparticles

After washing nickel nanoparticles with ethanol twice and toluene twice, 100 g of the nickel nanoparticles were added to 1000 mL of ethylene glycol and the mixture was stirred at 180° C. for 2 hours. The nickel nanoparticles were analyzed for the presence of chlorine ions remaining on the surface of the nanoparticles as shown in Table 3.

TABLE 3

| | Concentration of remaining chlorine ions (g/L) |
|---|---|
| Bare (no treatment) | 5.6 |
| ethylene glycol treatment | 0.0041 |

The thickness of a multi layer ceramic capacitor (MLCC) can be reduced and a packing factor can be improved by removing efficiently chlorine ions remaining on the surface of nickel nanoparticles so that it allows thinner multi layer ceramic capacitors and improved utilities of metal nanoparticles as fuel cell catalysts, hydrogenation reaction catalysts, alternative catalysts of platinum (Pt) in chemical reactions and the like.

FIG. 1 illustrates washing efficiency after removing chlorine ions remained on the surface of metal nanoparticles. It is noted that chunks of chlorine ions are reduced after washings.

While the spirit of the present invention has been described in detail with reference to particular embodiments, the embodiments are for illustrative purposes only and shall not limit the present invention. It is to be appreciated that those skilled in the art can change or modify the embodiments without departing from the scope and spirit of the present invention. As such, many embodiments other than those set forth above can be found in the appended claims.

What is claimed is:

1. A method for cleaning metal nanoparticles the steps of comprising:

removing a surfactant existing on a surface of the metal nanoparticles, prepared in an organic solvent phase including the surfactant, by treating the metal nanoparticles with ethanol and toluene;

removing organic materials existing on the surface of the surfactant-removed metal nanoparticles by treating the metal nanoparticles with an alcohol solution or an organic acid solution; and removing chlorine ions from the organic materials-removed metal nanoparticles by treating the nanoparticles with a carbonic acid functional group-containing solution, an acidic solution, ethylene glycol or pure water.

2. The method of claim 1, wherein the alcohol solution comprises a C1-C10 alcohol.

3. The method of claim 1, wherein the alcohol solution comprises 5-100 vol % alcohol.

4. The method of claim 1, wherein the organic acid solution comprises $C_nH_{2n+2}COOH$ or $C_nH_{2n}COOH$ ($0 \leqq n \leqq 12$, n=a natural number).

5. The method of claim 1, wherein the carbonic acid functional group-containing compound is ammonium bicarbonate ($NH_4HCO_3$) or metal bicarbonate ($MHCO_3$, M is a metal).

6. The method of claim 1, wherein the carbonic acid functional group-containing solution comprises 0.1-100 wt % of a carbonic acid functional group-containing compound.

7. The method of claim 1, wherein the carbonic acid functional group-containing solution comprises 10-30 wt % of a carbonic acid functional group-containing compound.

8. The method of claim 1, wherein the acidic solution comprises at least one acid selected from the group consisting of acetic acid, hydrochloric acid, nitric acid and sulfuric acid.

9. The method of claim 1, wherein the metal nanoparticles are washed 1 to 100 times with the ethylene glycol to remove the chlorine ions.

10. The method of claim 1, wherein a heating or ultrasonic treatment of the metal nanoparticles is performed together in each step.

11. The method of claim 5, wherein the metal bicarbonate ($MHCO_3$, M is a metal) is at least one selected from the group consisting of sodium bicarbonate ($NaHCO_3$), potassium bicarbonate ($KHCO_3$), lithium bicarbonate ($LiHCO_3$), rubidium bicarbonate ($RbHCO_3$), magnesium bicarbonate ($MgHCO_3$) and calcium bicarbonate ($CaHCO_3$).

12. The method of claim 10, wherein the metal nanoparticles are heated at 30-300° C.

13. The method of claim 10, wherein the metal nanoparticles are treated with 1 W-10 MW of ultrasonic wave for 10 seconds to 24 hours.

* * * * *